US006929452B1

(12) United States Patent
Pargeter et al.

(10) Patent No.: US 6,929,452 B1
(45) Date of Patent: Aug. 16, 2005

(54) PLENUM FAN BANDING

(75) Inventors: Stephen J. Pargeter, Tulsa, OK (US); Brent Stockton, Broken Arrow, OK (US)

(73) Assignee: AAON, Inc., Tulsa, OK (US)

( * ) Notice: Subject to any disclaimer, the term of this patent is extended or adjusted under 35 U.S.C. 154(b) by 94 days.

(21) Appl. No.: 10/390,969

(22) Filed: Mar. 18, 2003

(51) Int. Cl.[7] ..... F01D 5/22
(52) U.S. Cl. ..... 416/186 R; 415/912
(58) Field of Search ..... 416/186 R, 146 R, 416/205; 415/912

(56) References Cited

U.S. PATENT DOCUMENTS

| | | | | |
|---|---|---|---|---|
| 1,770,328 A | * | 7/1930 | Titterington | 416/186 R |
| 1,849,557 A | * | 3/1932 | Stelzer | 416/186 R |
| 2,807,871 A | * | 10/1957 | Wagner et al. | 416/186 R |
| 3,225,422 A | * | 12/1965 | Sebok | 416/186 R |
| 4,253,796 A | | 3/1981 | Philipps et al. | |
| 4,634,341 A | | 1/1987 | Monroe | |
| 4,662,819 A | | 5/1987 | Lakowske et al. | |
| 5,161,941 A | | 11/1992 | Ratner | |
| 5,207,557 A | | 5/1993 | Smiley, III et al. | |
| 5,586,861 A | | 12/1996 | Berger | |
| 5,827,044 A | | 10/1998 | Yazici et al. | |
| 6,377,426 B2 | | 4/2002 | Hugghins et al. | |
| 6,419,450 B1 | | 7/2002 | Lum | |
| 6,592,329 B1 | * | 7/2003 | Hirose et al. | 416/203 |

FOREIGN PATENT DOCUMENTS

| | | | | |
|---|---|---|---|---|
| JP | 61197800 | * | 9/1986 | F04D 29/28 |
| JP | 510294 | * | 5/1993 | F04D 29/44 |

* cited by examiner

*Primary Examiner*—Edward K. Look
*Assistant Examiner*—Igor Kershteyn
(74) *Attorney, Agent, or Firm*—Molly D. McKay

(57) ABSTRACT

Plenum fan banding that effectively changes the width of the fan blades in a plenum fan for a HVAC unit. A removable and replaceable band attaches to the back of a fan wheel of the plenum fan so that the band is located within the circle of the fan blades and extends outward perpendicular to the back of the wheel. The band is provided with tabs that insert through slots provided in the back of the fan wheel, and the tabs can be bent over as a means of removably securing the band to the fan wheel. The band effective reduces the functional width of the fan blades in proportion to the width of the band.

3 Claims, 2 Drawing Sheets

PLENUM FAN BANDING

BACKGROUND OF THE INVENTION

1. Field of the Invention

The present invention relates to a plenum fan banding. More specifically the present invention employs a removable and replaceable band that attaches to the back of a fan wheel so that the band extends outward perpendicular to the back of the wheel. Addition of the band to the back of the fan wheel changes the effective width of the fan wheel, thereby allowing the output of the fan, which is direct driven by a single speed motor, to be finely adjusted or trimmed to match the performance of the HVAC unit in which it is employed.

2. Description of the Related Art

It is desirable to match the performance of a plenum fan to the performance of the HVAC unit with which the fan is employed. Currently, there are two methods that are commonly employed to fine adjust or trim the plenum fan so that its performance can be matched to that of its associated HVAC unit.

The first of these two current methods for trimming a plenum fan is to employ a variable speed drive motor to drive the plenum fan instead of directly driving the fan with a single speed motor. A variable speed drive motor is more expensive to install than a single speed drive motor and a variable speed drive motor is more expensive to service. Also, one must be careful to use a variable speed or variable frequency drive (VFD) compatible motor.

The second of these two current methods for trimming a plenum fan is to adjust the width of the wheel of the fan. This requires that the wheel be replaced with another wheel of a different width, a process that is expensive and time consuming.

Other ways that the output of plenum fans have been adjusted include retracting the fan inlet funnel or otherwise restricting air flow going to the fan, changing the pitch of the fan blades, employing fan blades that can be adjusted outwardly, and moving the fan blades inward and outward relative to the fan housing.

Each of these methods has its own unique problems. The present invention addresses these problems by providing plenum fan banding that effectively changes the width of the fan blades without having to replace the fan or made major modifications to it. The present invention employs a removable and replaceable band that attaches to the back of a fan wheel so that the band extends outward perpendicular to the back of the wheel. This band can be constructed of a strip of sheet metal that is fastened at its ends to form a hoop of a uniform width. Several tabs are provided on one edge of the strip so that when that edge of the strip is facing the back of the fan wheel, the tabs can be inserted through slots provided in the back of the fan wheel as a means of securing the band to the fan wheel.

Once the tabs are fully inserted in their respective slots, the tabs are bent over, thereby holding the band securely to the fan wheel. When thus attached to the fan wheel, the band extends perpendicular to the back of the fan wheel and is located inside or within the circle of fan blades. By attaching the band to the fan wheel in this manner, the band changes the effective width of the fan wheel, thereby allowing the output of the fan, which is direct driven by a single speed motor, to be finely adjusted or trimmed to match the performance of the HVAC unit in which it is employed.

Also, because the band is attached by tabs to the back of the fan, by simply straightening the tabs back out, the tabs can be removed from the slots to thereby remove the band so that the band can be replaced by another band of a different width to again change the effective width of the fan blades and adjust the resulting output of the plenum fan.

SUMMARY OF THE INVENTION

The present invention is plenum fan banding that effectively changes the width of the fan blades without having to replace the fan or made major modifications to it. The present invention employs a removable and replaceable band that attaches to the back of a fan wheel so that the band extends outward perpendicular to the back of the wheel. This band is preferably constructed of a strip of sheet metal that is fastened together at its ends with rivets or other suitable fasteners to form a hoop that is of a uniform desired width. Several tabs are provided on one edge of the strip so that when that edge of the strip is facing the back of the fan wheel, the tabs can be inserted through slots provided in the back of the fan wheel as a means of securing the band to the fan wheel.

Once the tabs are fully inserted in their respective slots, the tabs are bent over, thereby holding the band securely to the fan wheel. When thus attached to the fan wheel, the band extends perpendicular to the back of the fan wheel and is located inside or within the circle of fan blades. By attaching the band to the fan wheel in this manner, the band changes the effective width of the fan wheel, thereby allowing the output of the fan, which is direct driven by a single speed motor, to be finely adjusted or trimmed to match the performance of the HVAC unit in which it is employed.

Also, because the band is attached by tabs to the back of the fan, by simply straightening the tabs back out, the tabs can be removed from the slots to thereby remove the band from the fan. This allows the band to be replaced by another band of a different width to thereby change the effective width of the fan blades and adjust the resulting output of the plenum fan.

DETAILED DESCRIPTION OF THE PREFERRED EMBODIMENT

Invention

Figure 2:
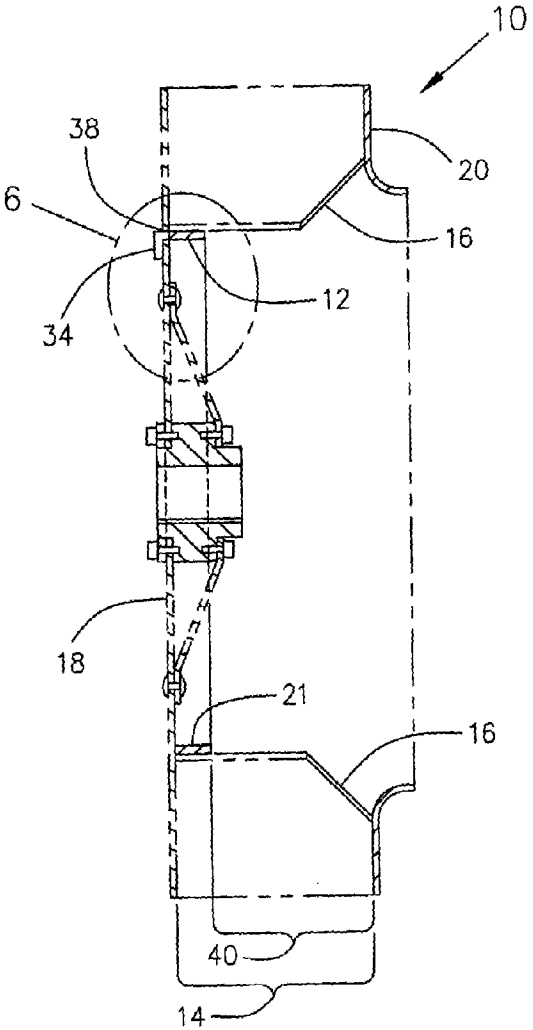
FIG. 2 is a cross sectional view taken along line 2—2 of FIG. 1.
Figure 1:
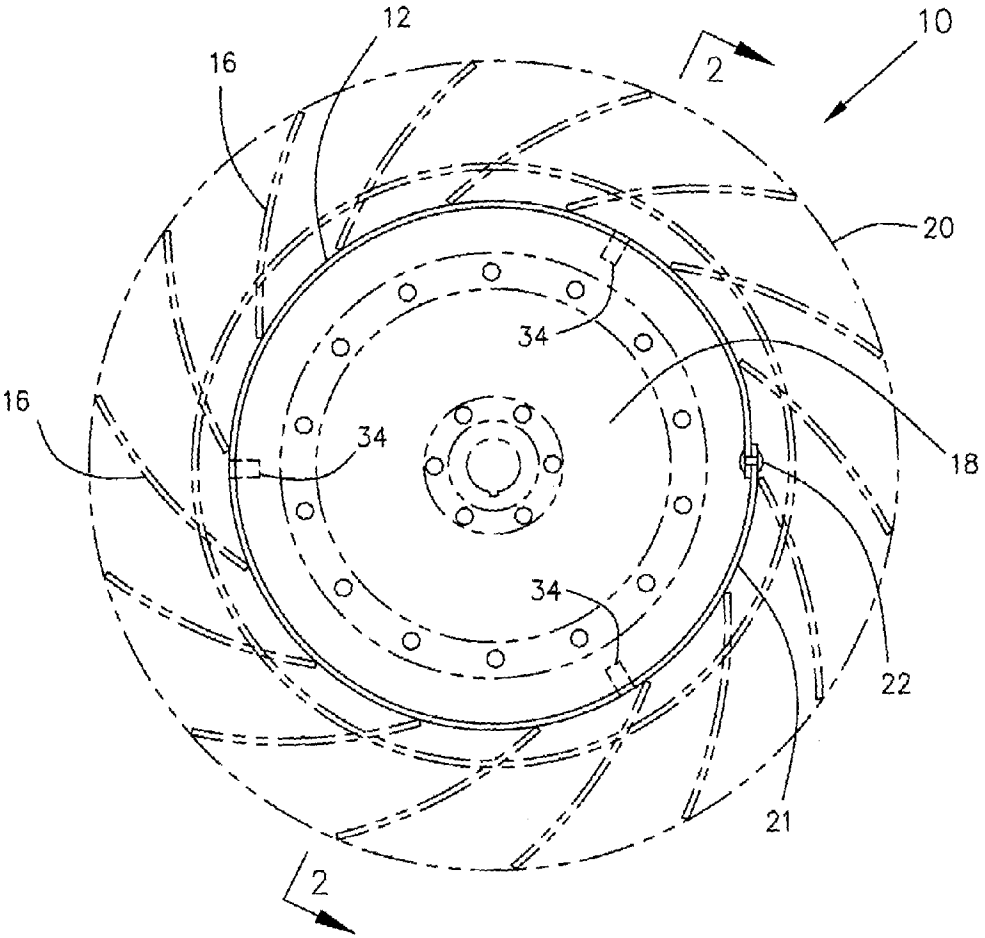
FIG. 1 is a front view of a plenum fan banding constructed in accordance with a preferred embodiment of the present invention.

Referring now to the drawings and initially to FIGS. 1 and 2, there is illustrated a plenum fan 10 with a band 12 that is constructed in accordance with a preferred embodiment of the present invention. The plenum fan banding 12 effectively changes the width 14 of the fan blades 16 without having to replace the fan blades 16 or made major modifications to the fan 10. The present invention employs a removable and replaceable band 12 that attaches to the back 18 of a plenum fan wheel 20 so that the band 12 extends outward perpendicular to the back 18 of the wheel 20. The fan wheel 20 is comprised of the back 18 and a circle of fan blades 16 that are attached to the back 18, as illustrated in FIGS. 1 and 2.

Figure 6:
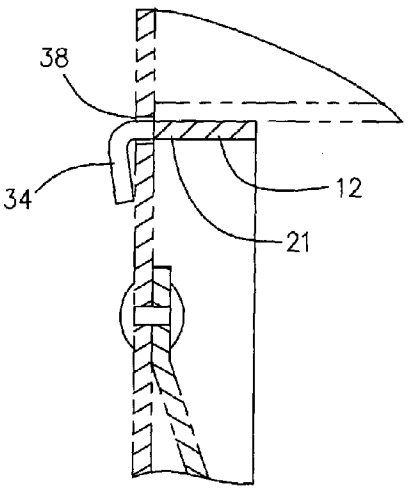
FIG. 6 is an enlarged view the area enclosed by circle 6 in FIG. 2.
Figure 5:
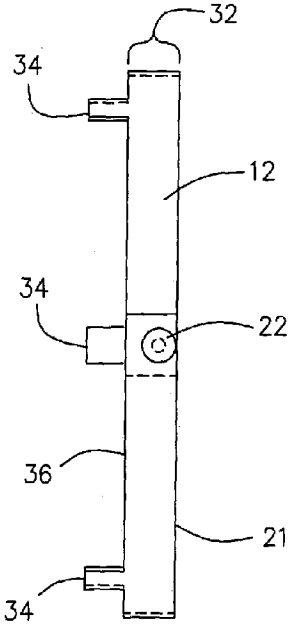
FIG. 5 is a side view of the band of FIG. 4 taken along line 5—5.
Figure 4:
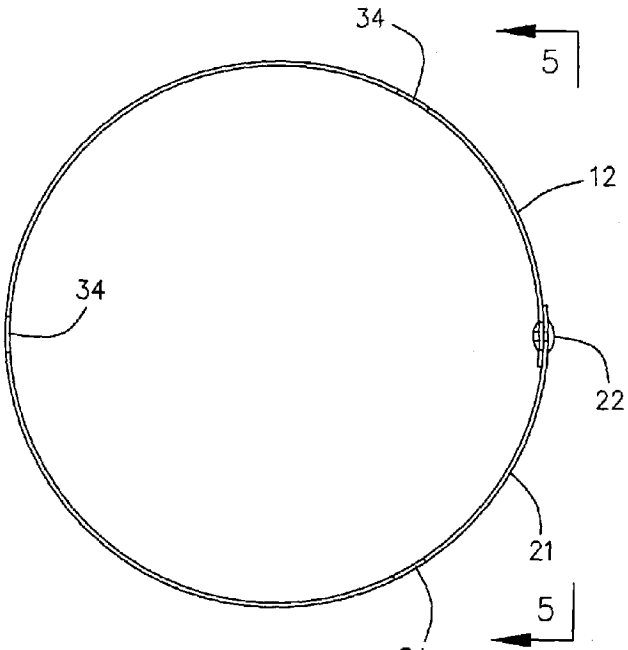
FIG. 4 is a front view of a band formed from the strip of FIG. 3 when the ends of the strip are secured together.
Figure 3:
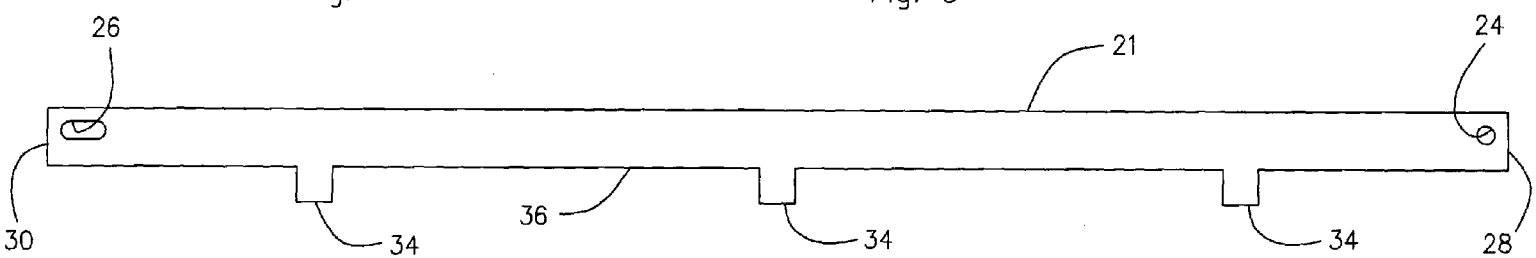
FIG. 3 is a plan view of a strip that will form a band to be employed in plenum fan banding.

As illustrated in FIGS. 3, 4 and 5, the band 12 is preferably constructed of a strip 21 of sheet metal that is fastened together at its two opposite ends 28 and 30 with rivets 22 or other suitable fasteners that insert through openings 24 and 26 provided in the ends 28 and 30 to form a hoop or circular band 12 that is of a desired uniform width 32. As best shown in FIGS. 5 and 6, several tabs 34 are provided on one edge 36 of the strip 21 so that when that edge 36 of the band 12 is facing the back 18 of the fan wheel 20, the tabs 34 can be inserted through slots 38 provided in the back 18 of the fan wheel 20 for the purpose of securing the band 12 to the fan wheel 20. As illustrated, the optimum number of tabs 24 may be approximately three in order to maintain balance in the fan wheel 20, although more tabs 24 may optionally be provided.

Once the tabs 24 are fully inserted in their respective slots 38, the tabs 24 are then bent over, as shown in detail in FIG. 6, thereby holding the band 12 securely to the fan wheel 20. When thus attached to the fan wheel 20, the band 12 extends perpendicular to the back 18 of the fan wheel 20 and is located inside or within the circle of fan blades 16, as illustrated in FIGS. 1 and 2. By attaching the band 12 to the fan wheel 20 in this manner, the band 12 effectively reduces the functional width 40 of the fan blades 16 on the fan wheel 20, thereby allowing the output of the fan 10, which is, although not illustrated, direct driven by a single speed motor, to be finely adjusted or trimmed to match the performance of the HVAC unit (not shown) in which it is employed.

Also, because the band 12 is attached to the back 18 of the fan wheel 20 with tabs 34 that have been bent over, by simply straightening the tabs 34 back out, the tabs 34 can be removed from the slots 38 to thereby remove the band 12 from the fan wheel 20. This allows the band 12 to be replaced by another band 12 of a different width 32 to again change the effective or functional width 40 of the fan blades 16, as illustrated in FIG. 2, and thereby adjust the resulting air flow output of the plenum fan 10.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. Plenum fan banding for changing the effective width of fan blades on a fan wheel comprising:

a hoop that will fit within a circle of fan blades of a plenum fan wheel, one edge of the hoop provided with means for removably securing the hoop to the back of said plenum fan wheel so that the hoop extends outward within the circle of fan blades, and said hoop further comprising a strip of metal, said strip having a uniform width, and means for securing opposite ends of the strip together to form the hoop.

2. Plenum fan banding according to claim 1 further wherein said hoop further comprises:

each end of the strip provided with openings there through, and a fastener inserting through one opening on each end of the strip to secure the ends together to form the hoop.

3. Plenum fan banding according to claim 2 wherein each fastener for securing the ends of the strip together is a rivet.

* * * * *